US006662481B1

(12) United States Patent
Hunter

(10) Patent No.: US 6,662,481 B1
(45) Date of Patent: Dec. 16, 2003

(54) CREWEL WORK STAND

(76) Inventor: Ronald B. Hunter, 6258 N. Steamboat Way, New Market, MD (US) 21774

( * ) Notice: Subject to any disclaimer, the term of this patent is extended or adjusted under 35 U.S.C. 154(b) by 0 days.

(21) Appl. No.: 10/201,026

(22) Filed: Jul. 24, 2002

(51) Int. Cl.[7] ..... D06C 3/08; D05C 1/02
(52) U.S. Cl. ..... 38/102.1; 38/102.2
(58) Field of Search ..... 38/102, 102.2, 38/102.21, 102.4, 102.9, 102.91, 102.1; 359/642, 809, 811; 362/33, 89, 98, 127, 217; 108/160, 28, 50.01

(56) References Cited

U.S. PATENT DOCUMENTS 579,472 A * 3/1897 Crawford ..... 38/102.21
3,774,325 A * 11/1973 Johnson et al. ..... 38/102.2
3,938,267 A * 2/1976 Bard ..... 38/102.1
4,189,856 A * 2/1980 Cookson ..... 38/102.4
4,229,890 A * 10/1980 Dropinski ..... 38/102.1
4,292,748 A * 10/1981 Miller ..... 38/102
4,422,250 A * 12/1983 Golan ..... 38/102.2
4,549,366 A * 10/1985 Gerding et al. ..... 38/102.2
4,561,177 A * 12/1985 Rancer ..... 29/721
5,027,989 A * 7/1991 Nevius ..... 223/120
5,351,424 A * 10/1994 Schulle et al. ..... 38/102.1

* cited by examiner

*Primary Examiner*—Ismael Izaguirre

(57) ABSTRACT

A crewel work stand for supporting needlecraft work and supplies used to work on the needlecraft. The crewel work stand includes a base member including side walls and cross members interconnecting the side walls; and also includes elongate upright support members being attached to the side walls of the base member; and further includes shelf units being mounted to the elongate upright support members; and also includes a workplace assembly including a platform being pivotally attached to the elongate upright support members, and also including needlecraft support hoop members being detachably attached to the platform; and further includes a light-emitting assembly being mounted to the elongate upright support members above the platform; and also includes a magnifying unit being pivotally mounted to the elongate upright support members above the platform.

8 Claims, 4 Drawing Sheets

CREWEL WORK STAND

BACKGROUND OF THE INVENTION

1. Field of the Invention

The present invention relates to needlework work stands and more particularly pertains to a new crewel work stand for supporting needlecraft work and supplies used to work on the needlecraft.

2. Description of the Prior Art

The use of needlework work stands is known in the prior art. More specifically, needlework work stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,351,424; U.S. Pat. No. 5,027,989; U.S. Pat. No. 4,549,366; U.S. Pat. No. 3,955,722; U.S. Pat. No. 3,774,325; and U.S. Pat. No. Des. 244,755.

While these devices fulfill their respective, particular objectives and requirements, the aforementioned patents do not disclose a new crewel work stand. The prior art includes inventions having stands, platforms, lights, and magnifying glasses for working on needlecrafts.

SUMMARY OF THE INVENTION

The general purpose of the present invention, which will be described subsequently in greater detail, is to provide a new crewel work stand which has many of the advantages of the needlework work stands mentioned heretofore and many novel features that result in a new crewel work stand which is not anticipated, rendered obvious, suggested, or even implied by any of the prior art needlework work stands, either alone or in any combination thereof. The present invention includes a base member including side walls and cross members interconnecting the side walls; and also includes elongate upright support members being attached to the side walls of the base member; and further includes shelf units being mounted to the elongate upright support members; and also includes a workplace assembly including a platform being pivotally attached to the elongate upright support members, and also including needlecraft support hoop members being detachably attached to the platform; and further includes a light-emitting assembly being mounted to the elongate upright support members above the platform; and also includes a magnifying unit being pivotally mounted to the elongate upright support members above the platform. None of the prior art includes the combination of elements of the present invention.

There has thus been outlined, rather broadly, the more important features of the crewel work stand in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new crewel work stand which has many of the advantages of the needlework work stands mentioned heretofore and many novel features that result in a new crewel work stand which is not anticipated, rendered obvious, suggested, or even implied by any of the prior art needlework work stands, either alone or in any combination thereof.

Still another object of the present invention is to provide a new crewel work stand for supporting needlecraft work and supplies used to work on the needlecraft.

Still yet another object of the present invention is to provide a new crewel work stand that is easy and convenient to set up and use.

Even still another object of the present invention is to provide a new crewel work stand that substantially lessens the amount of time needed to complete a needlecraft project.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
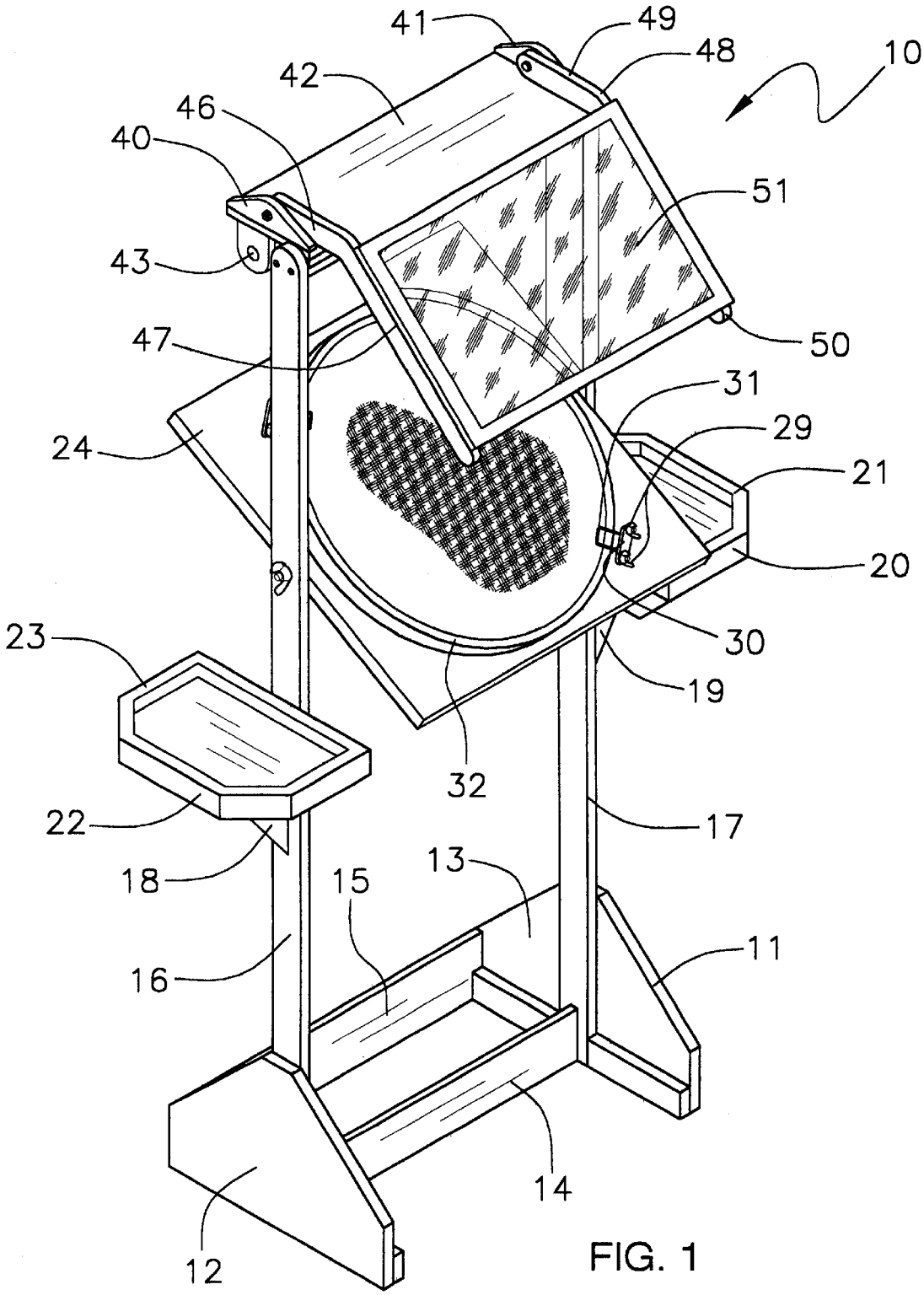
FIG. 1 is a perspective view of a new crewel work stand according to the present invention.
Figure 2:
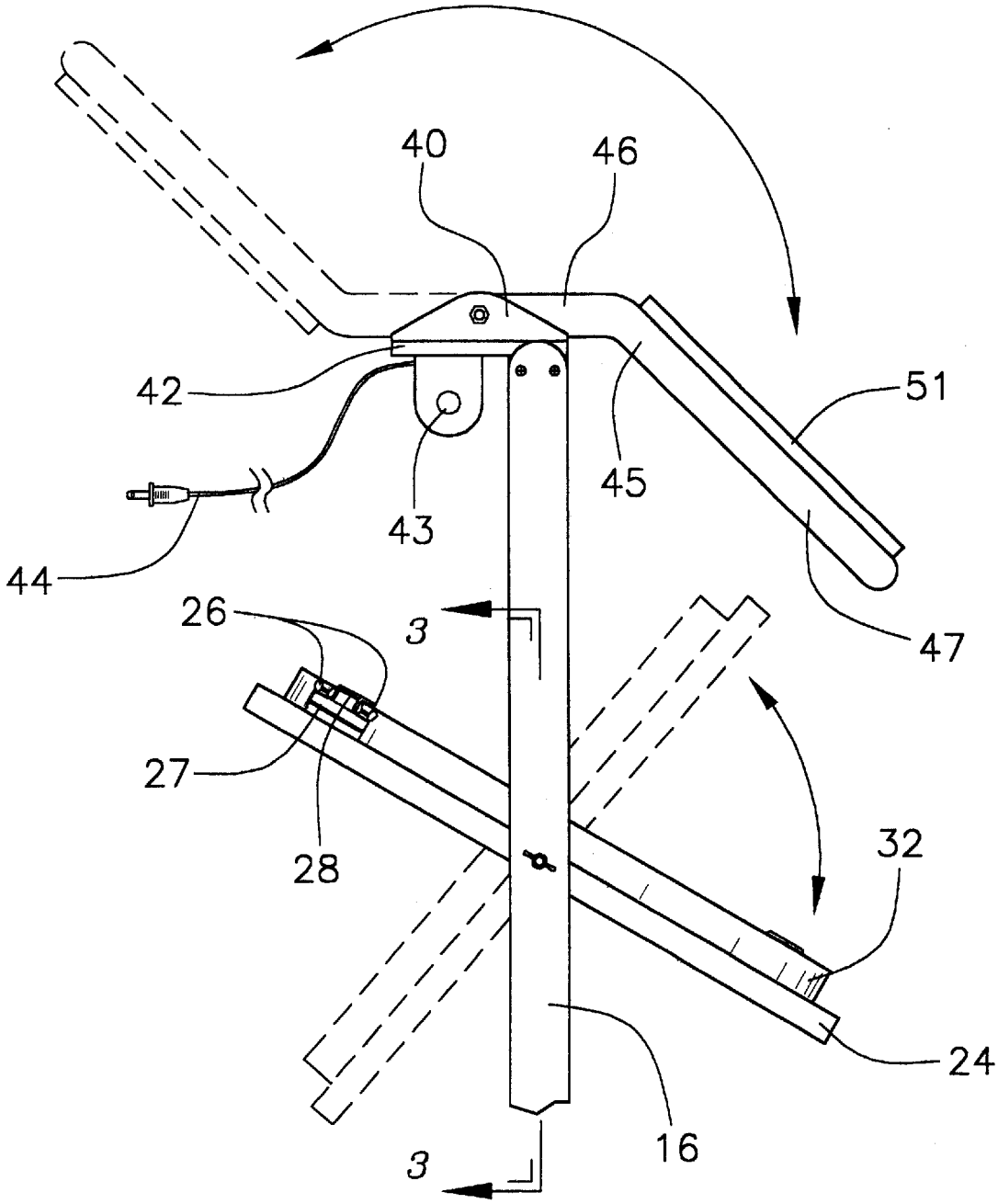
FIG. 2 is a side elevational view of the present invention.
Figure 3:
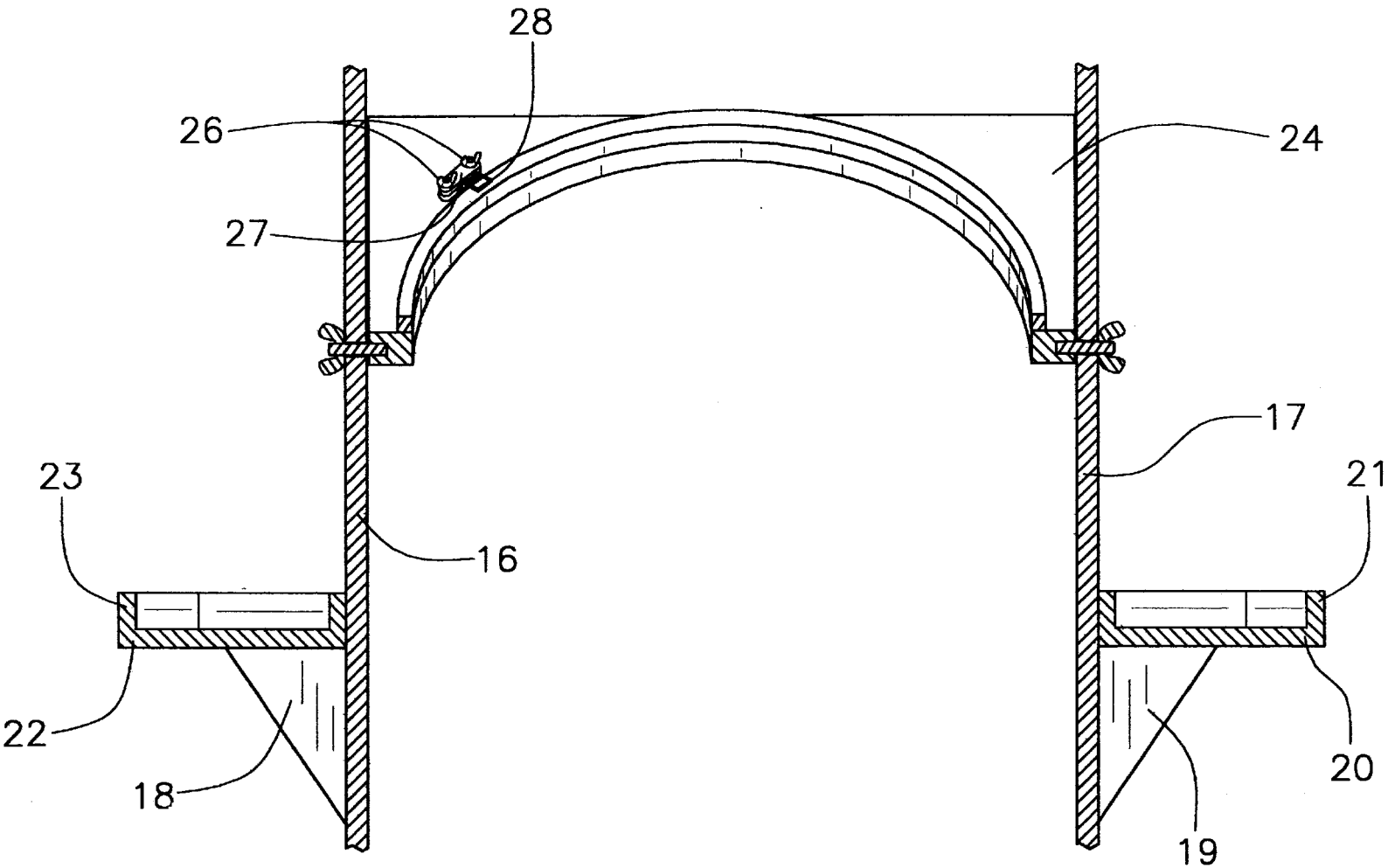
FIG. 3 is a partial cross-sectional view of the present invention.
Figure 4:
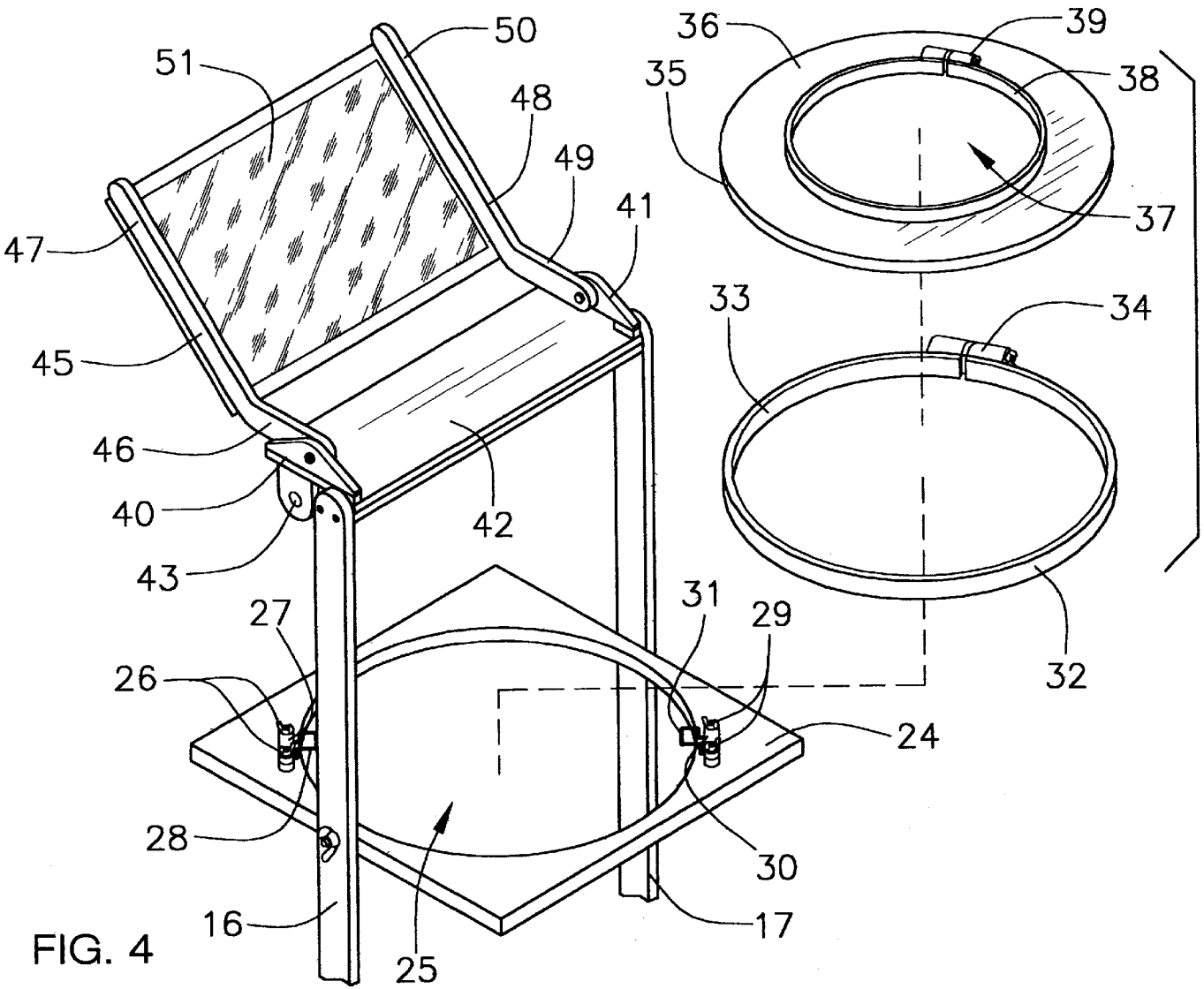
FIG. 4 is a partial exploded perspective view of the present invention.

With reference now to the drawings, and in particular to FIGS. 1 through 4 thereof, a new crewel work stand embodying the principles and concepts of the present invention and generally designated by the reference numeral 10 will be described.

As best illustrated in FIGS. 1 through 4, the crewel work stand 10 generally comprises a base member 11 including side walls 12,13 and cross members 14,15 conventionally interconnecting the side walls 12,13. Elongate upright support members 16,17 are conventionally attached to the side walls 12,13 of the base member 11. Shelf units are conventionally mounted to the elongate upright support members 16,17. Each of the shelf units includes a brace 18,19 being conventionally attached to an outer side of a respective elongate upright support member 16,17, and also includes a tray 20,22 being conventionally mounted upon the brace 18,19 and being conventionally attached to the elongate upright support member 16,17 with the outer side of the elongate upright support member 16,17 being faced away from the other the elongate upright support member 16,17. Each tray 20,22 has a raised ridge 21,23 being disposed along a perimeter thereof.

A workplace assembly includes a platform 24 being pivotally and conventionally attached to the elongate upright support members 16,17, and also includes needlecraft support hoop members 32,35 being detachably attached to the platform 24. The platform 24 has a circular opening 25 centrally disposed therethrough. The workplace assembly further includes clamp members 26–31 being conventionally attached along an edge forming the circular opening 25 of the platform 24. Each of the clamp members 26–31 includes fastening members 26,29, a bracket member 27,30, and a tongue member 28,32 being conventionally attached to the bracket member 27,30 for engaging the needlework support hoop members 32,35. The needlework support hoop members 32,35 includes a first needlework support hoop member 32 having a split hoop 33 and a fastener 34 for fastening the split hoop together 33; and also includes a second needlework support hoop member 35 having a hoop support member 36 with an opening 37 therethrough, and also having a split hoop member 38 being conventionally attached to the hoop support member 36 and being disposed in the opening 37 thereof, and further having a fastener member 39 for fastening the split hoop member 38 together with the needlework support hoop members 32,35 being removably clamped within the circular opening 25 of the platform 24.

A light-emitting assembly is conventionally mounted to the elongate upright support members 16,17 above the platform 24. The light-emitting assembly includes a pair of brackets 40,41 being securely and conventionally attached to top ends of the elongate upright support members 16,17, and also includes an elongate housing 42 being securely and conventionally attached to the brackets 40,41, and further includes a light-emitting member 43 being conventionally disposed in the elongate housing 42, and also includes a power cord 44 being conventionally connected to the elongate housing 42 for energizing the light-emitting member 43.

A magnifying unit is pivotally and conventionally mounted to the elongate upright support members 16,17 above the platform 24. The magnifying unit includes a pair of arms 45,48 having ends which are pivotally and conventionally attached to the brackets 40,41, and also includes a pane of magnifying glass 51 being conventionally attached to the arms 45,48. Each of the arms 45,48 includes a first portion 46,49 being pivotally and conventionally attached to a respective bracket 40,41, and also includes a second portion 47,50 which is angled relative to the first portion 46,49.

In use, the user clamps the appropriate needlework support hoop member 32,35 to the platform 24, and turns on the light-emitting member 43, and if needed, pivots the pane of magnifying glass 51 such that the user can look through the pane of magnifying glass 51 to work on the needlework which is conventionally secured to the needlework support member 32,35.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the crewel work stand. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A crewel work stand comprising:

a base member including side walls and cross members interconnecting said side walls;

elongate upright support members being attached to said side walls of said base member;

shelf units being mounted to said elongate upright support members;

a workplace assembly including a platform being pivotally attached to said elongate upright support members, and also including needlecraft support hoop members being detachably attached to said platform;

a light-emitting assembly being mounted to said elongate upright support members above said platform; and a magnifying unit being pivotally mounted to said elongate upright support members above said platform.

2. A crewel work stand as described in claim 1, wherein each of said shelf units includes a brace being attached to an outer side of a respective said elongate upright support member, and also includes a tray being mounted upon said brace and being attached to said elongate upright support member, said outer side of said elongate upright support member being faced away from the other said elongate upright support member, each said tray having a raised ridge being disposed along a perimeter thereof.

3. A crewel work stand as described in claim 2, wherein said platform has a circular opening centrally disposed therethrough.

4. A crewel work stand as described in claim 3, wherein said workplace assembly further includes clamp members being attached along an edge forming said circular opening of said platform, each of said clamp members including fastening members, a bracket member, and a tongue member being attached to said bracket member for engaging said needlework support members.

5. A crewel work stand as described in claim 4, wherein said needlework support hoop members includes a first needlework support hoop member having a split hoop and a fastener for fastening said split hoop together; and also includes a second needlework support hoop member having a hoop support member with an opening therethrough, and also having a split hoop member being attached to said hoop support member and being disposed in said opening thereof, and further having a fastener member for fastening said split hoop member together, said needlework support hoop members being removably clamped within said circular opening of said platform.

6. A crewel work stand as described in claim 5, wherein said light-emitting assembly includes a pair of brackets being securely attached to top ends of said elongate upright support members, and also includes an elongate housing being securely attached to said brackets, and further includes a light-emitting member being disposed in said elongate housing, and also includes a power cord being connected to said elongate housing for energizing said light-emitting member.

7. A crewel work stand as described in claim 6, wherein said magnifying unit includes a pair of arms having ends which are pivotally attached to said brackets, and also includes a pane of magnifying glass being attached to said arms.

8. A crewel work stand as described in claim 7, wherein each of said arms includes a first portion being pivotally attached to a respective said bracket, and also includes a second portion which is angled relative to said first portion.

* * * * *